United States Patent [19]

Scheidweiler

[11] Patent Number: 4,757,303

[45] Date of Patent: Jul. 12, 1988

[54] ALARM SYSTEM

[75] Inventor: Andreas Scheidweiler, Jona, Switzerland

[73] Assignee: Cerberus AG, Switzerland

[21] Appl. No.: 57,161

[22] Filed: Jun. 1, 1987

[30] Foreign Application Priority Data

Jun. 3, 1986 [CH] Switzerland ..... 2245/86

[51] Int. Cl.[4] ..... G08B 13/18; G08B 17/10; G08B 29/00

[52] U.S. Cl. ..... 340/501

[58] Field of Search ..... 340/501, 511, 526, 567, 340/588, 589, 628, 629, 577, 579

[56] References Cited

U.S. PATENT DOCUMENTS

| | | | |
|---|---|---|---|
| 3,909,813 | 9/1975 | Scheidweiler et al. . | |
| 4,270,123 | 5/1981 | Collard | 340/629 |
| 4,300,099 | 11/1981 | Maruyama | 340/629 |
| 4,302,753 | 11/1981 | Conforti | 340/628 |
| 4,459,583 | 7/1984 | van der Walt et al. | 340/511 |
| 4,514,720 | 4/1985 | Oberstein et al. | 340/511 |
| 4,598,271 | 7/1986 | Wagli et al. | 340/511 |

FOREIGN PATENT DOCUMENTS

| | | |
|---|---|---|
| 0158217 | 10/1985 | European Pat. Off. . |
| 2533382 | 7/1980 | Fed. Rep. of Germany . |
| 547532 | 3/1974 | Switzerland . |

*Primary Examiner*—John Chapman

*Attorney, Agent, or Firm*—Brumbaugh, Graves, Donohue & Raymond

[57] ABSTRACT

In an alarm system with a number of alarm devices such as fire intrusion alarm devices connected to a signal center, upper and a lower thresholds are defined in the alarm devices, with the inactive value of the sensor output signal located between the threshold limits. The alarm devices transmit one of three indication signals to the signal center depending on whether an alarm sensor output is above an upper limit, below a lower limit or between the upper and lower limits, with these alarm state signals being produced by threshold detectors. Also, it is possible to adjust the two threshold limits of the alarms to compensate for changing ambient conditions over extended periods of time. When the sensor output signal reaches one of the upper or lower thresholds both the upper and lower threshold limits either move up or down, respectively, so that the sensor output signal is once again located between the upper and lower threshold limits. The signal center receives the outputs of the threshold detectors and differentiates between five different states, namely the alarm states "normal," "warning," "alarm," "maintenance" and "malfunction", on the basis of the frequency and the type of these signals.

12 Claims, 2 Drawing Sheets

FIG. 5
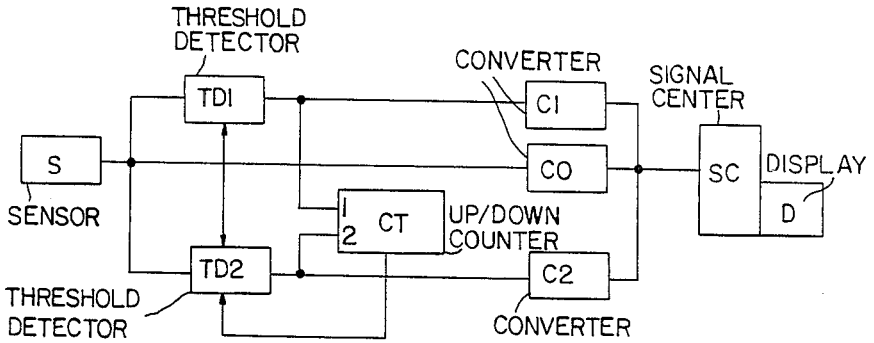
FIG. 6
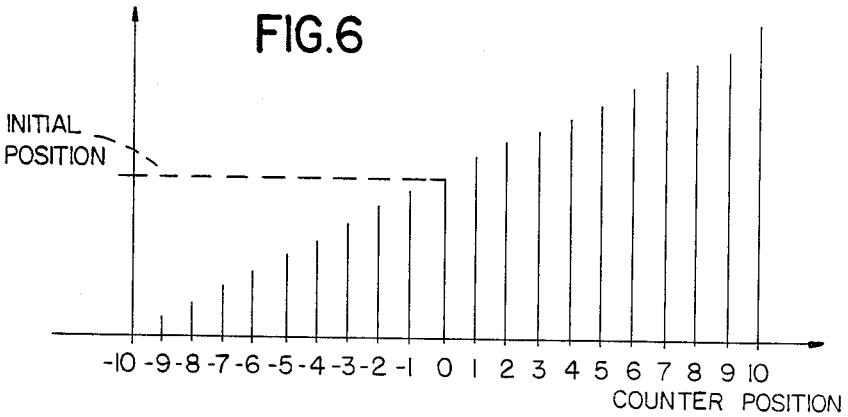
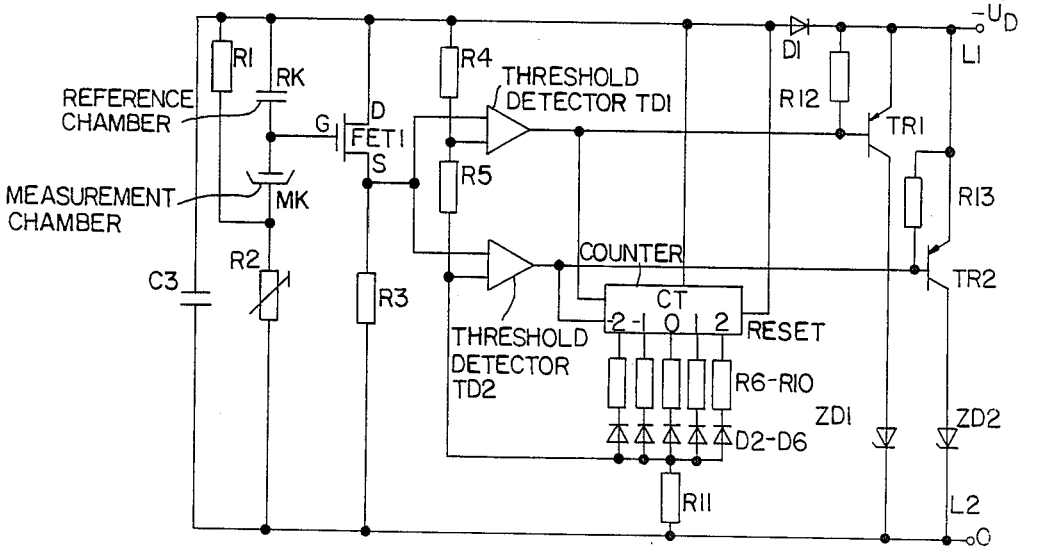
FIG. 7

FIG.1
PRIOR ART
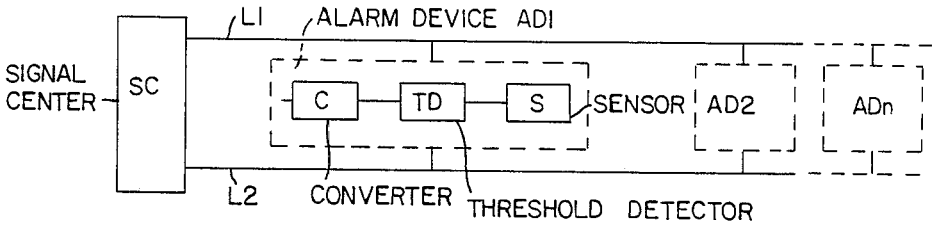
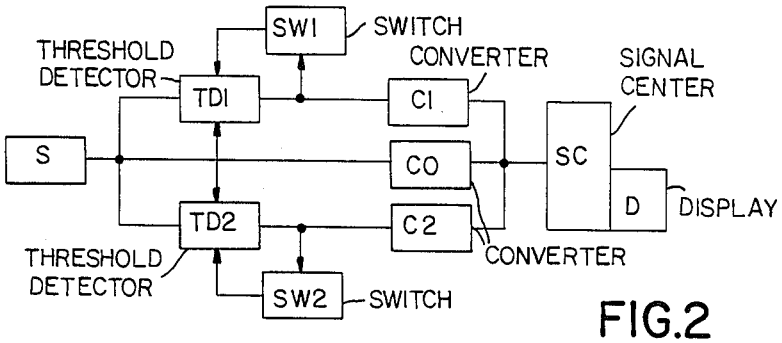
FIG.2
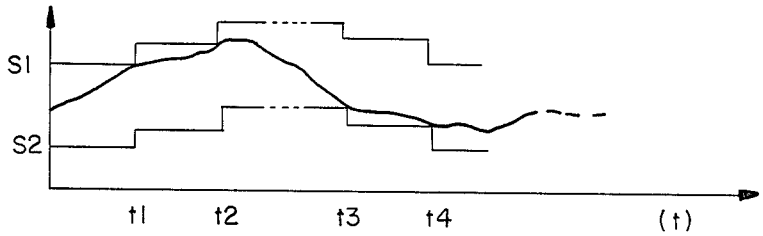
FIG.3
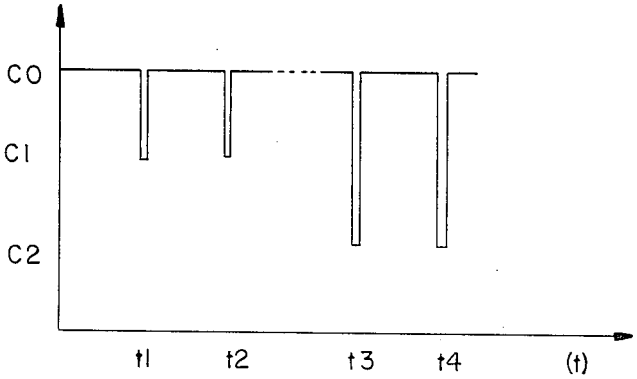
FIG.4

ALARM SYSTEM

BACKGROUND OF THE INVENTION

The invention concerns an alarm system in accordance with the general concept set forth herein below, in which a number of alarm devices, which are located on two-lead signal lines and which can have different electrical states, are connected with a signal center, where the signals transmitted by the individual alarm devices can be evaluated to obtain differentiated malfunction or fault warning alarm signals.

Automatic alarm systems have the purpose of recognizing danger, e.g. fires or unauthorized entries, as early as possible, in order to allow an effective defense. The alarm devices used in automatic alarm systems generally have at least one sensor which translates danger parameters, e.g. an increased temperature, the appearance of gas or smoke, a break-in, etc., into an electrical value. The alarm devices further contain at least one switching element which forms a threshold value to establish an alarm threshold. If the sensor output signal exceeds this threshold, an electrical converter present in the alarm device is triggered and the electrical status of the alarm device (voltage, current, impedance) changes suddenly. This change in status of the alarm device is transmitted to the signal center and evaluated and displayed there. An alarm device therefore generally has two states, the inactive state and the alarm state. However, there are also alarm systems known where the alarm devices are equipped with automatic monitoring devices which indicate a defect. In these systems, the alarm devices can therefore also have a third state, the so-called trouble or malfunction state. The main advantage of such alarm systems consists in the simple and reliable transmission of the signals.

Contradictory demands are placed on such alarm systems. On the one hand, they are intended to report danger at the earliest possible stage, in order to be able to initiate appropriate defense measures. For this purpose, highly sensitive sensors are used to recognize danger parameters, e.g. ionization smoke detectors or passive infrared alarms, etc. On the other hand, alarm systems are supposed to function with the greatest possible reliability, i.e. they are supposed to go off only when genuine danger is present. If such highly sensitive alarm devices are utilized, it nevertheless frequently occurs that disturbances cause an alarm signal, even though there is no danger present. Such malfunction can result in costly defense measures being activated unnecessarily, e.g. the police or the fire department may be called.

To overcome this disadvantage, therefore, alarm systems have been proposed, e.g. in Swiss CH-PS No. 547,532, where a pre-alarm signal is issued by a second threshold detector with a lower threshold value. During the time span between the pre-alarm signal and the alarm signal, it is possible to check whether there is real danger or whether there is a malfunction. In addition, alarm devices which tend to give off false alarms can thereby be recognized and replaced at an early stage, since the pre-alarm signal can also be interpreted as a malfunction or fault signal.

There have also already been proposals made for alarm systems in which various time delay switches would be activated after the alarm threshold is exceeded, in order to be able to check, before an alarm is sounded, whether there is a real danger situation. It is clear, however, that these alarm systems cannot meet the demand for an early alarm in case of danger.

Another disadvantage of the known alarm devices is that most are necessarily exposed to ambient contamination. This creates a risk that the sensor output signal will slowly be altered. This can have the result that the alarm devices either become blocked or have an increasing probability of giving off a false alarm. Therefore, alarm devices have been proposed in which the alarm threshold is slowly changed in accordance with the drift of the sensor output signal. Thus the distance between the inactive value and the alarm value remains constant within certain limits, which can extend the useful life of such alarms, particularly under severe ambient conditions. However, there remains the difficulty of recognizing the magnitude of the drift in the signal center.

In order to overcome the disadvantages mentioned, it has been proposed that instead of transmitting an alarm signal, the measurement value analog of the danger parameter to be measured should be transmitted to the signal center. Hence, the decision as to whether this is a real danger or a malfunction would be made in the signal center when a more accurate evaluation can be made on the basis of a comparison of the measurement values of different alarm devices.

In the method for transmission of measurement values in a fire alarm system proposed in W. German DE-PS No. 2,533,382, for example, measurement values determined by individual fire alarm devices attached to the alarm lines in a chain are transmitted as an analog signal to a signal center, and are there connected to obtain more differentiated malfunction or alarm reports, with all the fire alarms being cut off from the alarm line by a voltage change at the beginning of repetitive inquiry cycles, and then being turned on again in a predetermined sequence. Each individual fire alarm also connects the subsequent fire alarm device to the line voltage, after a time delay corresponding to its own measurement value, and in the signal center, the alarm address in each case is determined from the number of prior increases in the line current, and the levels of the individual measurement values are deduced from the length of the switching delay in each case.

It is a known fact, however, that the demands for transmission reliability become greater and greater the more information there is to be transmitted. The increasing electromagnetic contamination of our environment particularly has the result that the transmission of measurement values from the alarm device to the signal center is frequently disturbed. Although it is possible to recognize transmission errors using relatively simple means, this does require a certain amount of time, and precisely in the case of alarm systems this time is not available.

Therefore, there is a need for alarm systems which make it possible to transmit more information from the alarm device to the signal center, without having to accept the disadvantages of complicated transmission systems. The alarm systems in which a maximum of three states are reported therefore stand out on account of the great stability and reliability of the transmission caused by the transmission simplicity.

SUMMARY OF THE INVENTION

It is the purpose of the invention to create an alarm system which avoids the disadvantages mentioned above, which makes it possible to adapt two "event" thresholds of the alarm devices to changing ambient conditions over extended periods of time, to monitor the inactive value of the sensor output signal and which makes it possible to differentiate between rapid signal changes (fire, intrusion) and slow changes (drift of the inactive value) by the transmission of a maximum of three states.

A further purpose of the present invention is to create an alarm system in which there is a differentiation in the signal center between the warning state and the alarm state when there are rapid signal changes, with the warning state characterizing a lesser danger than the alarm state.

Another purpose of the present invention is to create an alarm system which gives off a maintenance alarm if the drift of the inactive value exceeds a predetermined initial value, and which gives off a malfunction alarm if the output signal of a sensor deviates so far from the inactive value that the alarm device ceases to be able to function.

According to the invention, an alarm system is provided comprising a signal center and a plurality of alarm devices connected to the signal center. Each alarm device comprises sensor means for producing an electrical signal having a characteristic indicative of a monitored condition and threshold detection means for comparing the electrical signal characteristic to minimum and maximum limits, and for producing an inactive indication signal when the characteristic is between the minimum and maximum limits, a below indication signal when the characteristic is below the minimum limit and above indication signal when the characteristic is above the maximum limit. Each alarm device also comprises converter means for transmitting the indication signals to the signal center, and switching means for increasing and decreasing both limits of the threshold detection means in response to above and below indication signals, respectively, whereby the minimum and maximum limits are adjusted to compensate for ambient conditions.

The signal center includes means for detecting different alarm conditions, including an alarm state, in response to the frequency and sequence of the indication signals so received.

BRIEF DESCRIPTION OF THE DRAWINGS

The invention is explained in more detail on the basis of the exemplary embodiments shown in the drawings which illustrate the following:

FIG. 1 shows a block schematic of a state-of-the-art alarm system;

FIG. 2 shows an alarm system according to the invention;

FIG. 3 shows a graphic representation of the sensor output signal of an alarm device used in the alarm system according to the invention;

FIG. 4 shows a graphic representation of the alarm output signals as a function of time, for an alarm device used in the alarm system according to the invention;

FIG. 5 shows the block schematic of another embodiment of an alarm system according to the invention;

FIG. 6 shows a graphic representation of the counter output signal as a function of the counter position of a counter used in an alarm device of an alarm system according to the invention; and FIG. 7 shows the wiring diagram of a preferred embodiment of an ionization smoke detector used in an alarm system according to the invention.

DESCRIPTION OF THE PREFERRED EMBODIMENT

In FIG. 1, a block schematic of an alarm system is shown, where alarm devices AD are connected with a signal center SC by means of two-lead lines L1 and L2. The alarm devices AD can be in one of three different states, which are transmitted to a signal center SC and are evaluated there, depending on the type of the incoming signal.

Both fire alarm devices and burglar (intrusion) alarm devices are possible alarm devices for consideration. Each alarm device AD has a sensor S, which sensitively reacts to the danger criterion to be detected and produces an electrical signal which changes continuously if the relevant danger parameter is present. This signal is passed on to a threshold detector TD which, when the established threshold has been exceeded, reports to an electrical converter C. This transformer produces a signal which is transmitted to the signal center SC as an alarm criterion. This alarm criterion consists in many cases of an easily detected voltage jump.

Several alarm devices AD are connected with the signal center SC by means of two-lead lines, with addresses frequently being assigned to the alarm devices AD in order to better identify the alarm reports.

FIG. 2 shows a block schematic of an alarm device AD which can be used in an alarm system according to the invention. The output of the sensor S is connected with a first threshold detector TD1, which determines an upper "event" threshold S1 for the sensor output signal, and with a second threshold detector TD2, which determines a lower "event" threshold S2 for the sensor output signal; the threshold detectors TD1 and TD2 have inputs by means of which the difference between the thresholds S1 and S2 remains constant, i.e. a change in S1 always results in a change in S2 of the same magnitude and in the same direction. The alarm devices AD are adjusted on the production line in the plant in such a way that the quiescent value of the sensor signal is practically in the center between the two thresholds S1 and S2.

The output of the sensor S is furthermore connected to a converter CO which produces a signal if the sensor output signal is located between the thresholds S1 and S2. This signal characterizes the normal state of the alarm. The first threshold detector TD1 is connected to a converter C1 which transmits a signal to the signal center SC if the alarm output signal exceeds the upper threshold S1 and the second threshold detector TD2 is connected to a converter C2 which transmits a signal to the signal center SC if the alarm output signal falls below the lower threshold S2. The signals transmitted to the signal center by the converters C1 and C2 are structured in such a way that they are clearly different from each other and from the signal which is transmitted by the converter CO. The three states which are transmitted to the signal center SC are designed as Z0- (normal state), Z1- (exceeding the upper "event" threshold S1) and Z2- (falling below the lower "event" threshold S2).

The outputs of the threshold detectors TD1 and TD2 are also connected to the converters C1 and C2 with switches SW1 and SW2 in such a way that each activation of switch SW1 effects an increase of the thresholds, and each activation of the switch SW2 effects a reduction of the thresholds, by a certain amount. The two threshold detectors TD1 and TD2 are functionally connected with one another in such a way that the amounts of the changes are of equal magnitude and in the same direction.

The operation of the alarm device according to the present invention is explained in more detail below, on the basis of FIGS. 3 and 4.

FIG. 3 shows the progression of the sensor output signal, as well as the position of thresholds S1 and S2 in each case. FIG. 4 shows the signals produced by the converters C0, C1 and C2, which are transmitted to the signal center SC.

When the alarm system is put into operation, the sensor output signal is approximately in the middle between the two thresholds S1 and S2. In this case, the first converter C0 is activated, i.e. the signal Z0 of the converter C0 is transmitted to the signal center SC, which means that the alarm is in the normal or inactive state.

Let it be assumed, for the time being, that the sensor signal increases slowly, as shown in FIG. 3. At the time t=t1, the sensor output signal reaches the upper threshold S1, which is detected by the first threshold detector TD1 and causes an increase in the upper threshold S1 and the lower threshold S2 by a pre-set amount, via the switch SW1. At the same time, the converter C1 is activated, which transmits a signal Z1 to the signal center SC.

After the switching of the two thresholds S1 and S2 by the first switch SW1, the sensor output signal is again between the two thresholds S1 and S2, so that the signal of the converter CD is transmitted again, i.e. the "normal state" is again registered in the signal center. In the case of a further increase in the sensor output signal, the same process recurs at the time t=t2.

Let us assume that the sensor output signal then slowly decreases and reaches the lower threshold S2 at the time t=t3. This is detected by the second threshold detector TD2 and causes a reduction, of the same magnitude, of the threshold S1 and S2 via the switch SW2. This time, the converter C2 is briefly activated, and its signal is sent to the signal center. In the case of a further reduction of the sensor output signal, the same process recurs at the time t=t4. The sensor signal is now in the original range again, i.e. the two thresholds have returned to their initial position, and the sensor output signal is between them.

In the signal center SC it can easily be determined, by selective recognition of the output signals Z0, Z1 and Z2 from the converters CD, C1 and C2, whether the sensor output signal have moved up or down. If we assume that the development over time of a danger signal is greater by several orders of magnitude than the changes in the quiescent values caused by ambient influences, such as dust or dirt, then in the signal center SC the following information can be obtained through this characteristic of the alarm devices AD:

If signals are received only occasionally, i.e. at intervals of more than a certain time period, e.g. several days, and if the difference in the number of signals from converters C1 and C2 on the average is equal to zero, this means that the sensor signal is slowly fluctuating around the quiescent value. This indicates that the alarm device AD is in the normal state.

Likewise, if output signals are received in the signal center only occasionally, i.e. on the order of greater than a certain time period, e.g. several days, but the number of one or the other output signal Z1 or Z3 predominates, so that the difference in the number of signals from converters C1 and C2 is not equal to zero, this means that the quiescent value of the sensor output signal is slowly shifting in a certain direction under the influence of ambient factors. By determining certain tolerance ranges, criteria for the necessity of a maintenance inspection can be derived in a simple manner. The size of the tolerance range is set in such a way that a maintenance signal is emitted before the sensor output signal has drifted so much that the alarm device can no longer function. By automatically changing the "event" thresholds of the alarm devices, the response sensitivity is kept constant.

Thus, by taking the difference of the number of signal of the converter C1 and the converter C2 it is always possible to determine the position of the sensor signal and the direction of the change in the signal center SC. In particular, a malfunction alarm can be given off if the difference of the signals of the two converters C1 and C2 has exceeded a certain value favoring signals from converter C2, such that the alarm device can no longer function.

By automatically adjusting the thresholds, the alarm sensitivity is kept constant, i.e. the alarm device still functions after a maintenance request has been signalled. If however, the time intervals between the signals from the converter C1 become shorter, such that a rapid increase of the sensor signal has to be concluded from this, then this signifies an increasing danger. Alarm and warning criteria can be defined by suitable evaluation in the signal center and can be displayed there on Display D.

FIG. 5 shows a further embodiment of an alarm system according to the invention, in the form of a block diagram. The output of a sensor S, as with the embodiment according to FIG. 2, is connected to two threshold detectors TD1 and TD2, and to a converter C0, which transmits the normal state of the alarm device AD to the signal center SC. Instead of the two switches SW1 and SW2, a forward/ backward or up/down counter CT is utilized. This counter CT has separate inputs for counting forwards (1) and backwards (2). The output of the first threshold detector TD1 is connected to the "forward" input of the counter CT and to a converter C1. The output of the second threshold detector TD2 is connected to the "backward" input 2 of the counter CT and to a converter C2. The output of the counter CT is connected to the input of the second threshold detector TD2 provided for this purpose. The two threshold detectors TD1 and TD2 are functionally connected with one another in such a way that with each counting process of the counter CT, the two thresholds S1 and S2 are both switched up or down by a certain equal value. The counter CT is wired in such a way that a certain output voltage corresponds to every counter position. At start-up, the counter CT is in the middle position, which corresponds to the initial position of the thresholds S1 and S2 of the threshold detectors TD1 and TD2.

FIG. 6 graphically shows the counter output voltage as a function of the counter position using the example of a twenty-step counter. In the initial position, the counter position is zero, the counter output voltage corresponds to the quiescent value of the threshold detector TD2 in FIG. 5. If the sensor output signal increases, then the counter value is increased by one when the upper threshold S1 is reached. Accordingly, the counter output voltage is increased by a certain amount. If the sensor output signal falls beneath the lower threshold S2, the reverse process takes place; the counter value is decreased by one and, accordingly, the counter output voltage is reduced by an amount equal to the preceding increase. This automatically adjusts the thresholds S1 and S2 in case of corresponding changes in the sensor output signal.

FIG. 7 shows another embodiment of an alarm system according to the invention, in the form of a block diagram, where an ionization smoke detector, which is connected to a signal center SC by way of supply lines L1 and L2, is used as the alarm device M. In the fire alarm device M, there is a measurement ionization chamber MK with a reference chamber RK which serves as a resistor element and a resistor R2 in series with (connected to) a zero potential. Parallel to the measurement and reference chambers MK and RK, there is a resistor R1 in series with the adjustable resistor R2. The common connecting point of measurement chamber MK and reference chamber RK is connected with the gate electrode G of a field effect transistor FET. The field effect transistor FET functions as an impedance transformer to transform the high-ohm measurement chamber potential. The drain electrode D of the field effect transistor FET is directly connected to the first supply line L1 via the diode D1. The source electrode s of the field effect transistor FET is connected to the input of two comparators or threshold detectors TD1 and TD2, and the output voltage of the field effect transistor FET (i.e. the voltage across the resistor R3) has been adjusted in the plant, by changing the resistor R2, in such a way that it is located in the middle between the two thresholds S1 and S2 of the comparators or threshold detectors TD1 and TD2. The thresholds S1 and S2 are determined by the voltage divider comprised of the resistors R4 and R5, and by the output signals of the counter CT. As an example, a counter CT with five settings is shown.

The output voltage of the counter CT results from the counter position and from the value resulting from the voltage divider of the resistors R6 to R10 with the resistor R11. The diodes D2 to D6 are used to uncouple the counter output signals. In case the output signal of the field effect transistor FET goes above or below the thresholds S1 and S2, the forward or backward counting inputs of the counter CT are activated.

At start-up, the counter CT is in the center position, which corresponds to the initial setting of the thresholds S1 and S2 of the threshold detectors TD1 and TD2. The counter CT is wired in such a way that it is reset if the voltage at the "reset" input is reduced to a certain value. When this happens, the counter automatically resets to the center position.

As long as the output signal of the field effect transistor FET stays between the thresholds S1 and S2 of the comparators or threshold detectors, the transistors TR1 and TR2 are inhibited, and the voltage Ub is applied to the alarm output.

If smoke penetrates into the measurement chamber MK of the ionization sensor, then this produces an increase in the measurement chamber voltage, in a known manner, and therefore an increase of the voltage across the resistor R3. If the threshold S1 of the comparator or threshold detector TD1 is reached, the counter switches from 0 to +1 and increases the voltage across R11 by a certain amount. At the same time, the threshold voltages of the threshold detectors TD1 and TD2 increase.

When the threshold S1 is exceeded, the transistor TR1, which is inhibited in the quiescent state, becomes conductive and switches on the Zener diode ZD1. Since the alarm has no current limitation, the voltage Ub breaks down to the Zener voltage UZ1, which is interpreted as signalling the Z1 state in the signal center.

If as the result of any ambient influence the sensor output voltage drops below the lower threshold S2 of the threshold detector TD2, the counter value is reduced by one, which results in a corresponding reduction of the thresholds S1 and S2. At the same time, the threshold detector TD2 activates the transistor TR2 (which is inhibited in the quiescent state), which switches on the Zener diode ZD2. This again results in a breakdown of Ub to the Zener voltage UZ2, which is interpreted as signalling the Z2 state in the signal center SC.

The diode D1 and the capacitor C3 stabilize the operating voltage of the sensor, comparator and counter during the voltage breakdowns. Since the sensor signal lies once again between the thresholds after every counting process, one of the two states Z1 or Z2 is transmitted for only a short period of time.

In the signal center SC, there are detectors which register both the type and the frequency of the incoming status messages.

The above-described advantageous characteristics of the alarm system according to the invention are particularly evident if the alarm devices are assigned an address, so that the origin of the signals can be recognized and assigned to a certain alarm device in the signal center.

In this case, one memory location per alarm device AD is provided in the signal center SC, with the current counter value of the alarm counters CT being evident there. This allows the possibility of individual remote monitoring of the alarm devices.

Different forms of the alarm system described are possible within the scope of the invention according to the patent claims, and are familiar to a person versed in the art.

I claim:

1. An alarm system, comprising:

a signal center;

a plurality of alarm devices, each alarm device comprising:

sensor means for producing an electrical signal having a characteristic indicative of a monitored condition, threshold detection means for comparing the electrical signal characteristic to minimum and maximum limits, and for producing an inactive indication signal when the characteristic is between the minimum and maximum limits, a below indication signal when the characteristic is below the minimum limit and an above indication signal when the characteristic is above the maximum limit, converter means for transmitting the indication signals to the signal center, and switching means for increasing and decreasing both limits of the threshold detection means in response to above and below indication signals, respectively, whereby the minimum and maximum limits are adjusted to compensate for ambient conditions;

wherein said signal center includes means for detecting different alarm conditions, including an alarm state, in response to the frequency and sequence of the indication signals so received.

2. The alarm system according to claim 1 wherein the switching means comprises a counter.

3. The alarm system according to claim 1 wherein the switching means comprises an up/down counter.

4. The alarm system according to claim 1 wherein each alarm device has a discrete address distinct from the other alarm devices, and wherein the signal center includes means for identifying which alarm devices are associated with the indication signals produced.

5. The alarm system according to claim 1, wherein the signal center includes a counter for each alarm device, wherein each counter maintains a count of the net number of increases and decreases effected by the switching means in the associated alarm device.

6. The alarm system according to claim 1 wherein the signal center includes a display for displaying the alarm states of the different alarm devices.

7. The alarm system according to claim 6 wherein the signal center includes override means for suppressing display of alarm conditions other than an alarm state.

8. The alarm system according to claim 1 wherein at least one of said alarm devices is a fire alarm.

9. The alarm system according to claim 8 wherein at least one of such alarm devices is a smoke alarm.

10. The alarm system according to claim 9 wherein at least one of said alarm devices is an ionization smoke detector.

11. The alarm system according to claim 1 wherein at least one of said alarm devices is an intrusion alarm.

12. The alarm system according to claim 11 wherein at least one of said alarm devices is a passive infrared intrusion detector.

* * * * *